US005201081A

United States Patent [19]

Knight

[11] Patent Number: 5,201,081

[45] Date of Patent: Apr. 13, 1993

[54] SHOWER CURTAIN SUPPORT HAVING COMBINED ANTI BILLOWING AND HANDLE MEANS

[76] Inventor: Tommy D. Knight, 204 Patricia Rd., Madison, Ala. 35758

[21] Appl. No.: 661,886

[22] Filed: Feb. 27, 1991

[51] Int. Cl.[5] ..... A47K 3/22

[52] U.S. Cl. ..... 4/609

[58] Field of Search ..... 4/608–610

[56] References Cited

U.S. PATENT DOCUMENTS 2,878,487 3/1959 Foote ..... 4/610

2,923,013 2/1960 Wasserman ..... 4/610

4,385,409 5/1983 File et al. ..... 4/610 X

*Primary Examiner*—Charles E. Phillips

*Attorney, Agent, or Firm*—Phillips & Beumer

[57] ABSTRACT

A slidably mounted curtain support for supporting a curtain, having an intermediate portion and a pair of spaced end portions at the end edge portions thereof in overlapping relation with at least one end wall of a pair of spaced end walls, which, with a rear wall, defines an enclosure such as a shower tub enclosure. The curtain support is mounted to a support rod and includes a primary arm and a secondary arm disposed in normal relation. The primary arm supports the portions of the intermediate portion adjacent to the end edge portions, and the secondary arm supports the end edge portions of the curtain. A downwardly extending arm serves as a handle to aid in the slidable movement of the certain along the rod and also engages the inner surface of the curtain to aid in preventing the curtain from billowing.

6 Claims, 3 Drawing Sheets

SHOWER CURTAIN SUPPORT HAVING COMBINED ANTI BILLOWING AND HANDLE MEANS

FIELD OF THE INVENTION

The present invention relates to a shower curtain support for suspending a shower curtain at the ends thereof in overlapping relation with at least a portion of the end walls defining a shower area. More particularly, the invention relates to such a curtain support having a combined anti billowing and handle (grasping) means for permitting the curtain to be moved into and out of overlapping relation with a portion of the end walls.

BACKGROUND OF THE INVENTION

In a typical shower or tub stall defined by a rear wall, two end walls, and an opening, a shower curtain is suspended from a shower curtain rod extending across the opening. The curtain is usually a flexible member which is slidably mounted to the rod by a plurality of hooks which is slidable along the outer surface or in an elongated slot provided in the rod to open or close the stall opening. A problem with this typical arrangement is that when the curtain is fully drawn across the stall opening, the edge of the shower curtain does not butt closely against the end walls of the shower stall to seal against leakage between the ends of the shower curtain and the end walls. An additional problem encountered in a typical installation is that in order to slide the shower curtain across the opening to open or close the opening, it is usually necessary to directly grasp the curtain material by hand below the hooks and slide the hooks along the rod by pulling on the shower curtain. Such "pulling" or "tugging" on the curtain tends to canter or tilt the hooks against the rod in such a manner as to cause binding the hooks to the rod and thus impede the sliding action of the hooks along the rod.

There are many prior art devices which purport to solve the problem of sealing the enclosure to prevent the water from splashing onto the surrounding floor. One such device is a sliding or hinged door. However, such doors are relatively expensive, usually require a professional for the installation, and are permanently installed.

U.S. Pat. No. 2,878,487, issued to Foote on Mar. 24, 1959, discloses a shower curtain adapter which hooks onto the curtain rod and is positioned against the inside surface of the curtain. The adapter includes a triangular frame which must be provided with hinge joints so that it can be pivoted inward into the shower enclosure and support the edge portion of the shower curtain so as to positioned the edge margin of the curtain in close proximity to the wall of the shower enclosure.

U.S. Pat. No. 4,385,409, issued to File et al. on May 31, 1983, discloses a shower bender for holding an end portion of a hanging shower curtain in close proximity to a vertical wall at the ends of a shower enclosure to prevent shower water spray from splashing outside the enclosure from between the hanging shower curtain and the enclosure end walls. The curtain bender includes a primary arm and a secondary arm. The primary arm extends normal to the end wall of the enclosure, and the secondary arm is pivotally mounted to the primary arm by a hinge which extends the secondary arm parallel to the end wall of the enclosure. The primary arm is comprised of a plurality of segments which are hinged together. Such structure is complicated by the use of the many hinges and is also made very expensive because of its reliance on the many hinges. It is also noted that in drawing the shower curtain to its open or closed position, one would tend to grasp the curtain material in the "tugging" motion described previously.

As can be seen from the above discussion, none of the aforementioned patents provide a simple curtain support member having no movable or hinged parts and which provides a means to slide the shower curtain in open and closed positions without the need to directly grasp the curtain material.

SUMMARY OF THE INVENTION

Accordingly, the present invention provides a shower curtain support which is simplistic in nature, easy to install, not visible from the outside of the shower, and easy to use. The device of the present invention includes a primary arm for supporting a portion of the shower curtain at the front of a shower or tub enclosure, a secondary arm for supporting the end edges of a shower curtain against the end walls of the enclosure, and a third downwardly depending handle (arm) all arranged in a modified "T" shape. The third or depending arm which is at the bottom of the "T" is provided to prevent billowing of the shower curtain and as a "grasping" point to direct the force of opening and closing to the primary and secondary arms. The primary arm contains a plurality of holes through which the shower curtain loosely fits and also serves to apply the force of opening and closing so that the curtain does not bind and also prevents the curtain holes from being pulled out. The secondary arm is disposed in normal relation to the primary arm to hold an end edge portion of the shower curtain against the end walls of the enclosure.

It is an object of the present invention, therefore, to provide a very simple, inexpensive shower curtain support.

It is another object of the present invention to provide such a shower curtain support for mounting the shower curtain to a curtain rod for ease of sliding movement of the curtain along the curtain rod.

It is still another object of the present invention to provide such a shower curtain support for mounting the shower curtain inwardly at its end edges in a manner which places its inwardly directed end edges in substantially parallel, mating relation with a pair of end walls of a shower enclosure or the like.

It is yet a further object of the present invention to provide a shower curtain support which may be grasped and moved for simultaneous movement of the curtain across the opening of the enclosure without the need for "tugging" on the shower curtain, per se.

Other objects of the invention will become apparent from the following detailed description taken in conjunction with the accompanying claims and drawings.

DETAILED DESCRIPTION OF THE DRAWINGS

FIG. 1 is a partial pictorial view of a shower enclosure utilizing the device of the present invention for holding an end section of a shower curtain against an end wall of a shower enclosure. The view is taken from within the enclosure and further illustrates the device as having an integral handle which is grasped to move the curtain in opening and closed positions. The device is shown to be a unitary structure having primary and secondary arms and a depending handle.

DETAILED DESCRIPTION OF THE INVENTION

Figure 1:
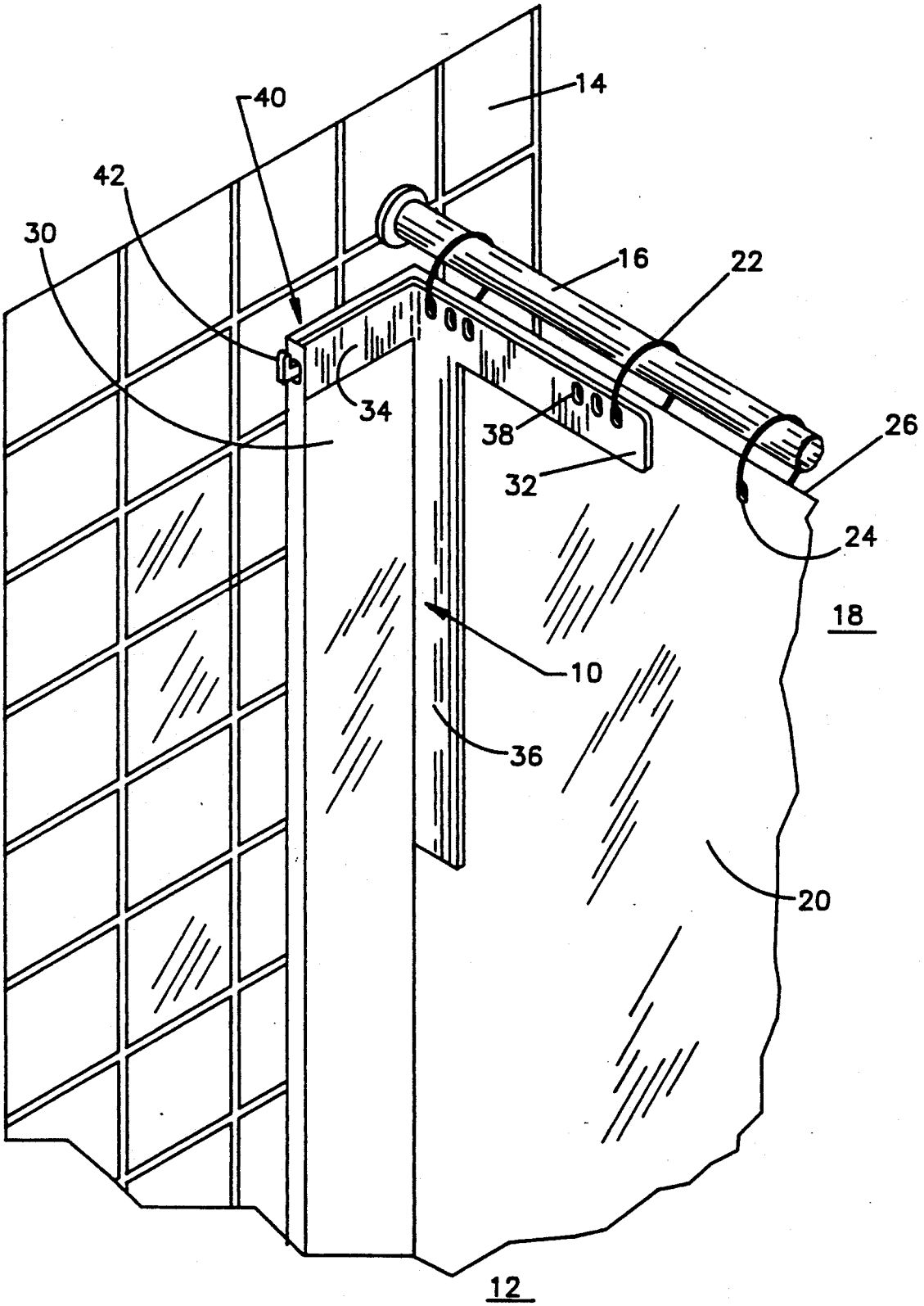

Referring now to the figures wherein like numerals refer to like parts, FIG. 1 illustrates the use of the shower curtain support 10 in a shower enclosure 12 having a pair of end walls 14 (only one shown) and a rear wall (not shown). A curtain rod 16 is secured to the end walls and extends across the intermediate open portion 18 of the enclosure. A shower curtain 20 is slidably supported on rod 16 by hook members 22 which extend in hook openings 24 provided in spaced relation along the top 26 of the curtain 20.

Shower curtain support 10 is shown positioned at one end edge 30 of curtain 20. Although support 10 may be mounted at both end edges of the curtain, only one is shown. Shower curtain support 10 is shown to be a single unitary member having a primary arm 32, a secondary arm 34, and a downwardly extending handle member 36. Primary arm 32 is provided with a plurality of spaced openings 38 and hook members 22 extend around rod 16 through openings 24 of the curtain and through the adjacent openings 38 of the primary arm to secure curtain support member 10 to rod 16 and to curtain 20.

Secondary arm 34 extends in normal relation from the primary arm and is provided on its distal end 40 with an integral hook 42. As more clearly shown in FIGS. 2 and 3, hook 42 includes an extending portion 44 and an upstanding portion 46 having a groove 48 therein.

Figure 2:
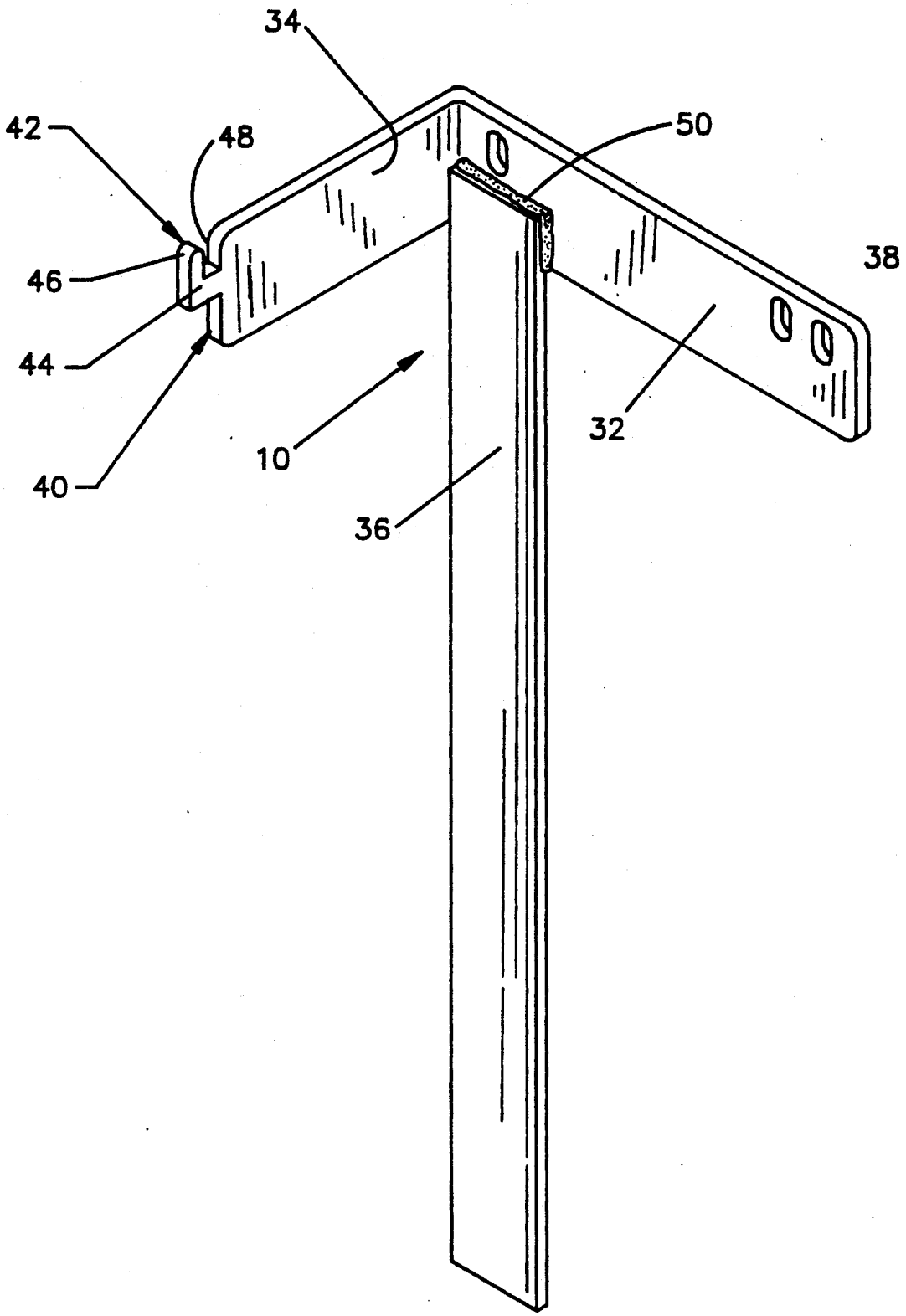
FIG. 2 is a pictorial view of a "left hand" shower curtain support wherein the primary and secondary arms are unitary, and the handle portion of the device is glued to the unitary member.

Another embodiment of the shower curtain support 10 is shown in FIG. 2 which illustrates a "left hand" support and wherein like numerals refer to like parts. In this embodiment, the curtain support 10 is shown to include the primary arm 32 and secondary arm 34 which is formed of a single piece of material. Handle member 36 is shown to be attached to the primary arm by glue 50.

Figure 3:
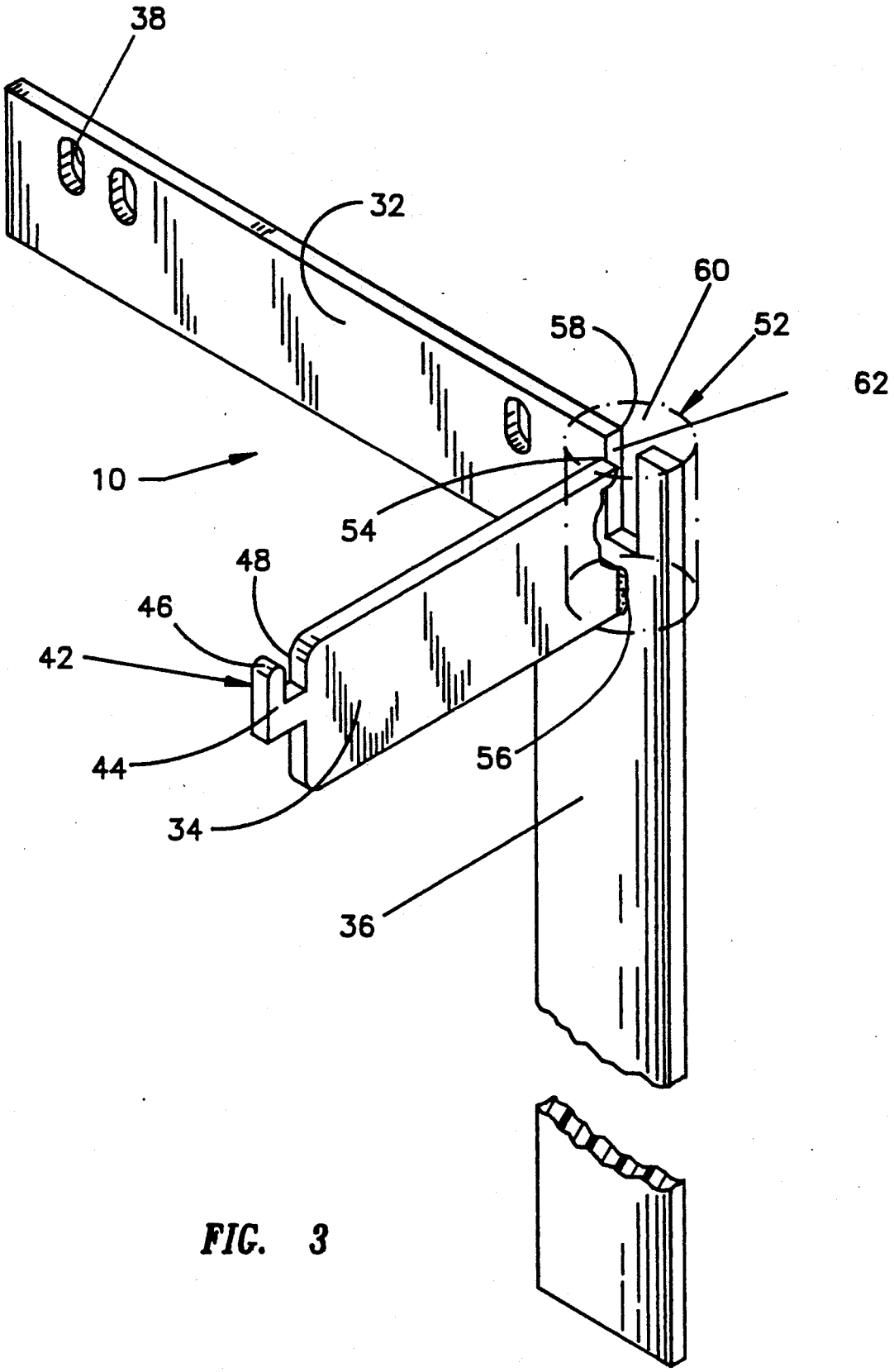
FIG. 3 is a pictorial view of a "right hand" shower curtain support wherein the primary arm and the handle are unitary, and the secondary arm is separately attached to the primary arm by a support member between the primary and secondary arms.

FIG. 3 illustrates a further embodiment of the curtain support 10 wherein the primary arm 32 and the handle member 36 is made of a single piece of material, and the secondary arm 34 is secured to an attaching member 52 (as by gluing). Member 52 is also attached to primary arm 32 by gluing. As can also be seen in FIG. 3, a member 52 includes an elongated slot 54 extends the length of the member, and secondary arm 34 is attached in slot 54 by glue 56. A second elongated slot 58 is provided through member 54 which fits over primary arm 32. Member 52 further includes an upper portion 60 which fits into a slot 62 arranged on the upper surface of arm 32.

It is to be understood that any of many types of substantially rigid materials, including plastics, may be used in the construction of the shower support as set forth herein.

It is to be further understood that various configurations may be resorted to including a configuration wherein the primary arm, secondary arm, and handle member may be separate members (so that they may be conveniently packaged) which are assembled together in any of many different ways at the time they are to be assembled to the shower curtain.

It is to be still further understood that although the support structure is described herein as supporting a shower curtain, the invention is not to be strictly held in such a limiting sense since, obviously, the support structure may be used for any enclosure in which a curtain or the like is to be used as a covering for the front and ends of the enclosure.

While particular embodiments of the concept of my invention have been disclosed, it is to be understood that those skilled in the art may make various changes and modifications without departing from the spirit and scope of the appended claims.

I claim:

1. In combination with a curtain having end edge portions, an intermediate portion, and a top edge portion having a plurality of spaced openings therein, a curtain rod extending between a pair of spaced end walls which, with a rear wall, define an enclosure, means for slidably supporting said curtain on said rod, comprising:

a curtain support including an elongated primary arm having opposed ends and a secondary arm having opposed ends with one end of the secondary arm attached to one end of the primary arm in a generally perpendicular orientation for supporting said curtain for movement into and out of overlapping, sealing relation with a portion of at least one end wall, said primary and secondary arms being disposed for non-movable, non-pivotal relation therebetween, said primary arm having a plurality of spaced openings along the length thereof;

first attachment means for attaching said primary arm and said intermediate portion of said curtain to said curtain rod, said first attachment means defined by a plurality of curtain support members slidably carried on said rod and extending through said spaced openings along the length of said primary arm and through a plurality of said spaced openings along said top edge portion of said curtain whereby said primary arm and said top edge portion of said curtain are attached together along the length of said primary arm and to said curtain rod for slidable movement therealong;

second attachment means for attaching said curtain to said secondary arm, said second attachment means including a hook-like member extending from the distal end of said secondary arm for insertion into a said opening along the top of said curtain near at least one edge portion of said curtain for moving said at least one edge portion of said curtain into and out of overlapping, sealing relation with a portion of said at least one end wall; and an elongated anti-billowing and handle means depending downwardly from the primary arm so that then said primary arm is attached to the top edge of said curtain, said anti-billowing and handle means will function to prevent billowing of said curtain toward the interior of said enclosure and will serve as a handle for a user to grasp in order to move said curtain into and out of said sealing relation.

2. The combination of claim 1 wherein said primary arm, said secondary arm, and said anti billowing and handle member is a one-piece member.

3. The combination of claim 1 wherein said primary arm and said secondary arm are formed of a one-piece extending in normal relation from the juncture of said arms.

4. The combination of claim 3 wherein said anti billowing and said handle means is an elongated member secured to said primary arm adjacent to said juncture of said arms.

5. The combination of claim 1 wherein said primary arm and said handle are formed of a single member, an attachment member secured to said primary arm, said secondary arm being secured to said attachment member.

6. The combination of claim 1 wherein said enclosure is a shower enclosure.

* * * * *